US007929709B2

(12) United States Patent
Katayama

(10) Patent No.: US 7,929,709 B2
(45) Date of Patent: Apr. 19, 2011

(54) SOUND IMAGE LOCALIZATION APPARATUS

(75) Inventor: Masaki Katayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1153 days.

(21) Appl. No.: 11/642,860

(22) Filed: Dec. 21, 2006

(65) Prior Publication Data

US 2007/0154020 A1 Jul. 5, 2007

(30) Foreign Application Priority Data

Dec. 28, 2005 (JP) ..... 2005-379625

(51) Int. Cl.
*H04R 5/00* (2006.01)

(52) U.S. Cl. ..... 381/17; 381/1; 381/18; 381/307; 381/309; 381/310

(58) Field of Classification Search ..... 381/1, 17, 381/18, 307, 309, 310
See application file for complete search history.

(56) References Cited

U.S. PATENT DOCUMENTS 6,683,959 B1 1/2004 Kuwano et al.
2007/0258607 A1* 11/2007 Purnhagen et al. ..... 381/307

FOREIGN PATENT DOCUMENTS

JP 2001-86599 A 3/2001

* cited by examiner

*Primary Examiner* — Vivian Chin
*Assistant Examiner* — Paul Kim
(74) *Attorney, Agent, or Firm* — Crowell & Moring LLP

(57) ABSTRACT

A sound image localization apparatus comprises an L direct output section that produces an output signal by inputting an audio signal of a rear left audio input channel to a filter having a characteristic obtained by dividing RLD by LD, an L cross output section that produces an output signal by inputting the audio signal of the rear left audio input channel to a filter having a characteristic obtained by dividing RLC by LC, an R cross output section that produces an output signal by inputting an audio signal of a rear right audio input channel to a filter having a characteristic obtained by dividing RRC by RC, an R direct output section that produces an output signal by inputting the audio signal of the rear right audio input channel to a filter having a characteristic obtained by dividing RRD by RD, a first adding section that adds a difference signal between the output signal of the L direct output section and the output signal of the R cross output section to an audio signal of a front left audio input channel, and a second adding section that adds a difference signal between the output signal of the R direct output section and the output signal of the L cross output section to an audio signal of a front right audio input channel.

2 Claims, 4 Drawing Sheets

SOUND IMAGE LOCALIZATION APPARATUS

BACKGROUND OF THE INVENTION

The present invention relates to a sound image localization apparatus which realizes rear virtual sound image localization by outputting, from front speakers, rear channel sounds that have been subjected to signal processing that uses head-related transfer functions which simulate spatial propagation characteristics from the surroundings to human ears.

Recently, various apparatus have been disclosed which realize various kinds of sound image localization by using model head-related transfer functions (hereinafter abbreviated as "head-related transfer functions) which simulate spatial propagation characteristics from the surroundings to human ears. Furthermore, since arranging real multi-channel speakers results in a large-scale system and is not practical, a sound image localization apparatus has been proposed which realizes rear virtual sound image localization by performing crosstalk cancellation which cancels spatial propagation characteristics and adds rear sound image localization (JP-A-2001-86599). The crosstalk cancellation is considered a prerequisite for the addition of rear localization. That is, to realize accurate sound image localization, it is considered necessary to add rear sound image localization on condition that spatial propagation characteristics are canceled.

In the crosstalk cancellation, signal processing is performed to produce an effect that a sound generated by a front-left speaker is solely input to the left ear and a sound generated by a front-right speaker is solely input to the right ear by performing inverse transform on head-related transfer functions that simulate propagation characteristics from the front speakers. The crosstalk cancellation thereby produces an effect that a listener feels as if he or she were using a headphone.

In JP-A-2001-86599, FIG. 19 shows a crosstalk canceling method.

However, the crosstalk cancellation has a problem that it generally requires inverse transform calculations and hence requires large-scale processing. Furthermore, the manner of spatial propagation of a sound to an ear depends on each person because a sound is diffracted differently depending on the face width etc. Because of such a difference among individuals, there may occur a case that the effect of the rear virtual sound image localization (i.e., a listener feels as if he or she were hearing a sound coming from behind) is not obtained at all. Another problem of this sound image localization is that it is effective in a pinpointed manner, that is, it is sensitive to the installation angles of speakers and the face direction.

SUMMARY OF THE INVENTION

In view of the above, an object of the present invention is to realize rear virtual sound image localization more reliably by simple calculations in a sound image localization apparatus for realizing rear virtual sound image localization.

In the invention, means for solving the above problems is configured as follows:

(1) The invention provides a sound image localization apparatus comprising:

an L direct output section for producing an output signal by inputting an audio signal of a rear left audio input channel to a filter having a characteristic obtained by dividing RLD by LD;

an L cross output section for producing an output signal by inputting the audio signal of the rear left audio input channel to a filter having a characteristic obtained by dividing RLC by LC;

an R cross output section for producing an output signal by inputting an audio signal of a rear right audio input channel to a filter having a characteristic obtained by dividing RRC by RC;

an R direct output section for producing an output signal by inputting the audio signal of the rear right audio input channel to a filter having a characteristic obtained by dividing RRD by RD;

a first adding section for adding a difference signal between the output signal of the L direct output section and the output signal of the R cross output section to an audio signal of a front left audio input channel; and a second adding section for adding a difference signal between the output signal of the R direct output section and the output signal of the L cross output section to an audio signal of a front right audio input channel, where:

LD is a head-related transfer function which simulates spatial propagation from a real speaker FL disposed at a front-left position to a left ear;

LC is a head-related transfer function which simulates spatial propagation from the real speaker FL to a right ear;

RC is a head-related transfer function which simulates spatial propagation from a real speaker FR disposed at a front-right position to the left ear;

RD is a head-related transfer function which simulates spatial propagation from the real speaker FR to the right ear;

RLD is a head-related transfer function which simulates spatial propagation to the left ear from a virtual speaker VL which is disposed symmetrically with the real speaker FL with respect to a center line L that passes through the center of a head of a listener and extends in a right-left direction of the listener;

RLC is a head-related transfer function which simulates spatial propagation from the virtual speaker VL to the right ear;

RRC is a head-related transfer function which simulates spatial propagation to the left ear from a virtual speaker VR which is disposed symmetrically with the real speaker FR with respect to the center line L; and RRD is a head-related transfer function which simulates spatial propagation from the virtual speaker VR to the right ear.

The L direct output section, the L cross output section, the R cross output section, and the R direct output section of the invention processes audio signals of the rear audio input channels. The filtering calculations on these audio signals are such that the audio signals are merely input to the filters each having a characteristic obtained by dividing one transfer function by another. Therefore, a sound image localization apparatus can be realized by performing simple calculation.

An experiment that was conducted by the inventors confirmed that the apparatus according to the invention causes, more reliably, a listener to feel as if sounds were being output from behind than signal processing (inverse-of-matrix calculations) with crosstalk cancellation according to the conventional theory does. One reason why the apparatus according to the invention can produce better results than the processing which employs the calculations according to the conventional theory would be that the conventional apparatus does not operate exactly according to the conventional theory because the conventional theory employs the model that is based on observation results of one set of head-related transfer functions and is different from a real system including an actual listener. Therefore, the fact that the invention produces better results than the processing which employs the calculations according to the conventional theory is not contradictory to a natural law.

An experiment that was conducted by the inventors confirmed that the effect of the invention is not sensitive to the face direction of a listener and the virtual feeling that sounds are being output from behind is not impaired even if the listener moves forward or backward with respect to the front real speakers. It is supposed that the invention utilizes, in a sophisticated manner, the fact that the virtual feeling of a human that sounds are being output from behind is not apt to be influenced by the directions of sound sources.

In one example of the configuration of item (1), a rear localization adding section 131 shown in FIG. 1 (described later) corresponds to the output sections and parts of the adding sections. However, the invention is not limited to this example.

The characteristic obtained by dividing RLD by LD is a gain characteristic obtained by dividing the gain of RLD by the gain of LD. The same applies to the L cross output section, the R cross output section, and the R direct output section.

The term "real speaker" means a speaker that is installed actually and is a concept opposite to the virtual speaker which is not installed actually.

(2) In the invention, the real speakers are set so as to be symmetrical with each other with respect to the right-left direction of the listener and the virtual speakers are also set so as to be symmetrical with each other with respect to the right-left direction of the listener, and the head-related transfer functions LD and RD are made identical, LC and RC are made identical, RLD and RRD are made identical, and RLC and RRC are made identical.

With this configuration, since left and right head-related transfer functions of each pair can be made identical, it is expected that the apparatus can be made simpler than in the case of item (1). Furthermore, since left and right head-related transfer functions of each pair are completely the same, it is expected that the phenomenon that complex peaks and dips appear in the frequency characteristics of the filters that are based on head-related transfer functions is suppressed and the apparatus thereby becomes more robust, that is, more resistant to a positional variation of a listener (dummy head). The apparatus of item (2) would improve the sense of localization that sounds are being output from behind, as compared to the case of item (1).

The invention realizes rear virtual sound image localization more reliably by outputting sounds of rear audio input channels from front speakers. Furthermore, the effect of the invention is not sensitive to the face direction of a listener and the virtual feeling that sounds are being output from behind is not impaired even if the listener moves forward or backward with respect to the speakers.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Outline of Embodiment

Figure 1:
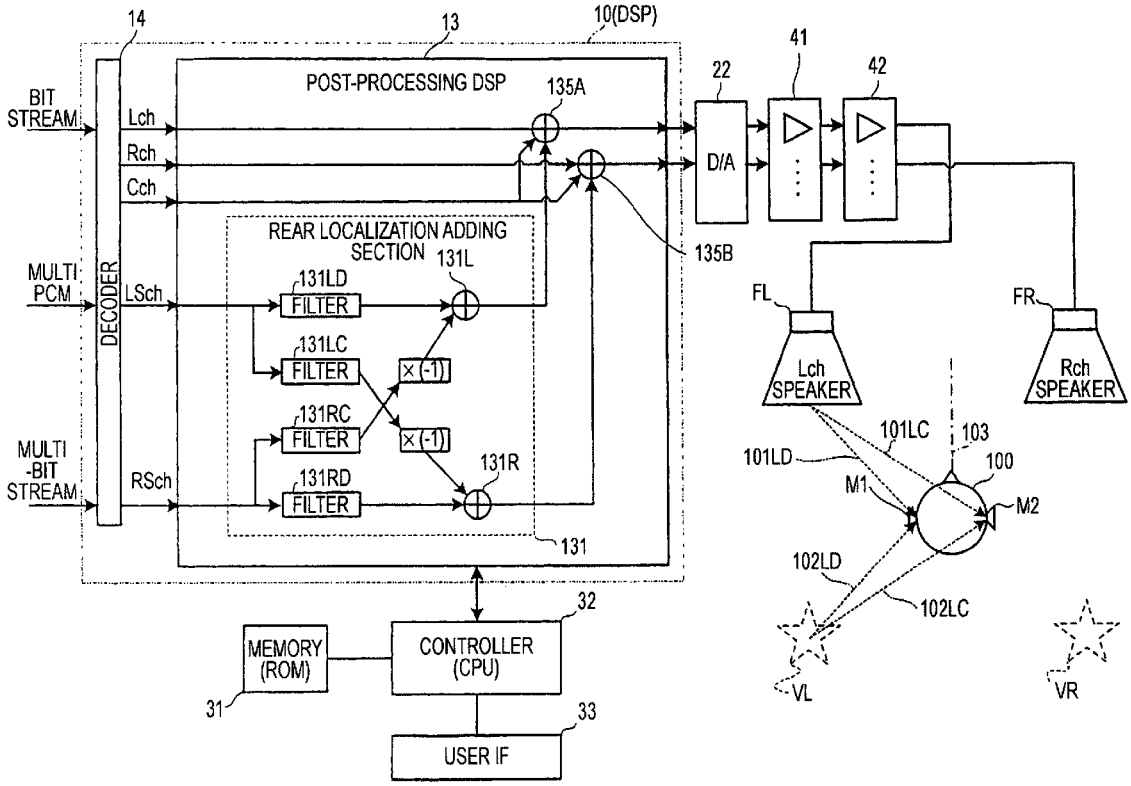
FIG. 1 shows the internal configuration of a sound image localization apparatus according to an embodiment.

A sound image localization apparatus according to an embodiment will be outlined below with reference to FIGS. 1 to 3. FIG. 1 shows the internal configuration of the apparatus according to the embodiment. It is assumed that as shown in the right-hand part of FIG. 1 an Lch speaker FL and an Rch speaker FR are actually disposed obliquely (with respect to a direction 103 of the face of a listener (dummy head) 103) in front of the listener 100. As for signal systems, as shown on the left side of a DSP 10, front left and right audio input channel signals Lch and Rch and rear left and right audio input channel signals LSch and RSch which are produced through decoding by a decoder 14 are input to a post-processing DSP 13. The rear left and right audio input channel signals LSch and RSch are subjected to signal processing in a rear localization adding section 131 and resulting signals are added to the front left and right audio input channel signals Lch and Rch by adders 135A and 135B. In this manner, sound image localization for rear virtual speakers VL and VR is realized (this is hereinafter called "addition of rear localization"). The reason why sound image localization for the rear virtual speakers VL and VR is performed is that outputting multi-channel sounds through real speakers requires a large-scale system and is not necessarily practical.

To realize such rear virtual sound image localization, the apparatus of this embodiment uses modified versions of model head-related transfer functions which simulate transfer characteristics from the speakers to both ears. The apparatus of this embodiment is characterized in the rear localization adding section 131. The conventional apparatus is equipped with a crosstalk canceling circuit for canceling transfer characteristics from the speakers FL and FR to both ears M1 and M2 (refer to JP-A-2001-86599). In the apparatus of this embodiment, the rear localization adding section 131 also performs processing that correspond to the crosstalk canceling correction.

Figure 2:
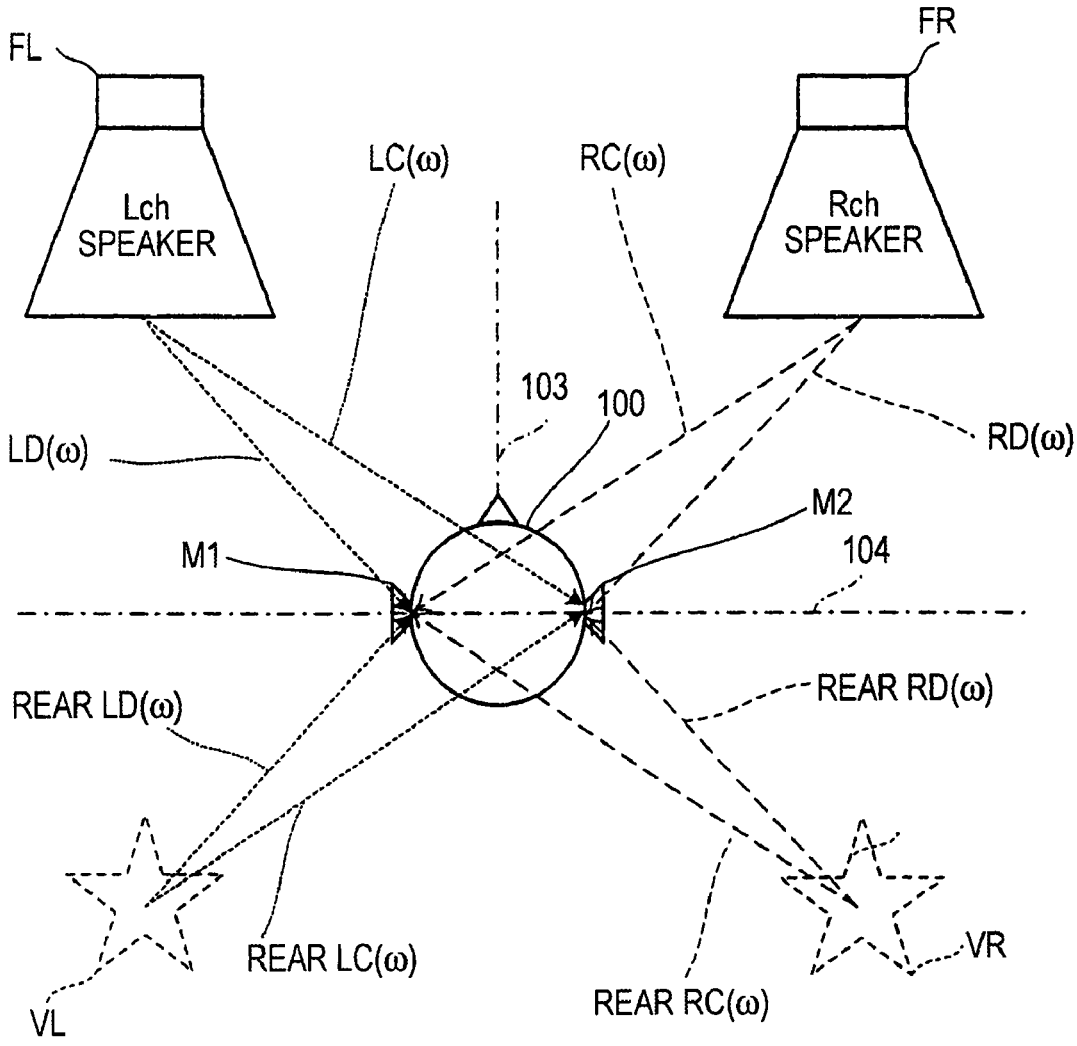
FIG. 2 shows a method for setting virtual sound sources of the sound image localization apparatus according to the embodiment and the definitions of head-related transfer functions used in the apparatus according to the embodiment.

A method for setting virtual sound sources is shown in FIG. 2. As shown in FIG. 2, in the apparatus of this embodiment, the virtual speakers VL and VR are set at positions that are symmetrical with the front real speakers FL and FR with respect to a center line 104

Figure 3:
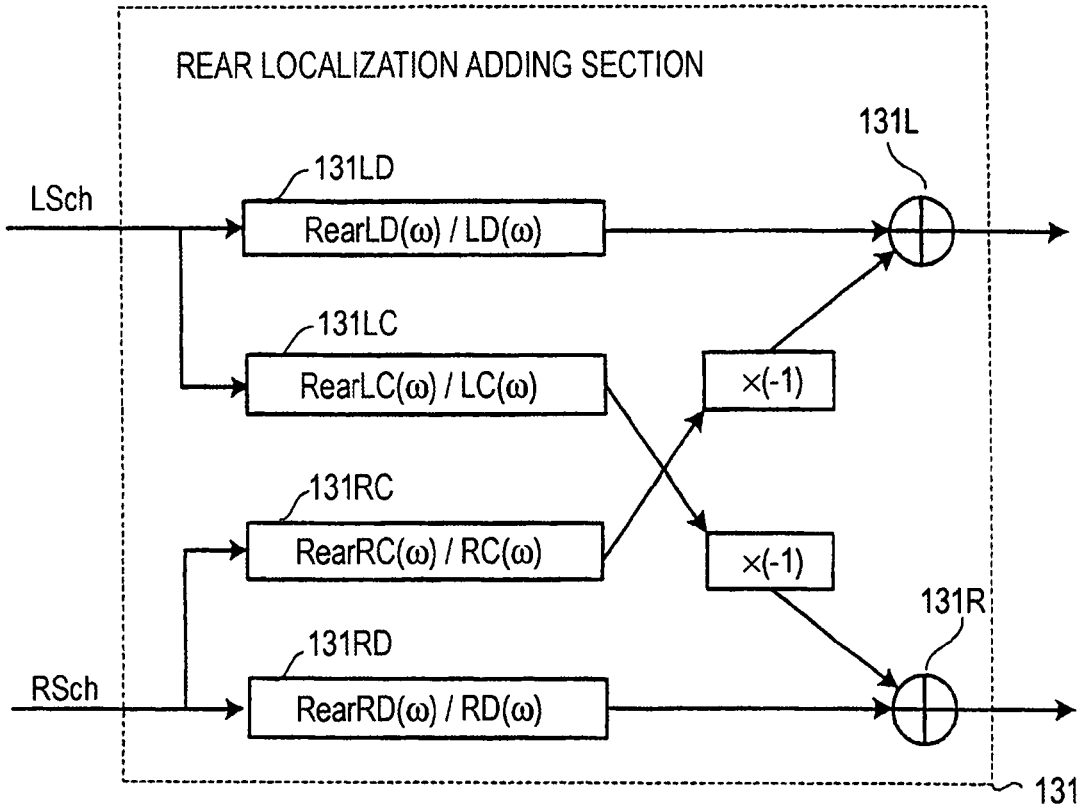
FIG. 3 shows a method for setting filters of a rear localization adding section of the sound image localization apparatus according to the embodiment.

As shown in FIG. 3, the rear localization adding section 131 uses filters having characteristics (converted into impulse responses) that are obtained by dividing the gains of head-related transfer functions RearLD(ω) and RearRD(ω) which simulate spatial propagation characteristics from the rear virtual speakers VL and VR to both ears for each angular frequency ω by the gains of head-related transfer functions LD(ω) and RD(ω) which simulate spatial propagation characteristics from the front speakers FL and FR to both ears. In the rear localization adding section 131, rear audio input channel signals LSch and RSch are multiplied by the characteristics of these filters and resulting signals are output. It is supposed that taking convolution with, in this manner, the characteristics of the filters obtained by the gain division produces an effect similar to the crosstalk cancellation which cancels transfer characteristics from the front speakers FL and FR to both ears M1 and M2.

Configuration of Sound Image Localization Apparatus According to Embodiment

The sound image localization apparatus according to the embodiment will be described below with reference to FIG. 1. As mentioned above, FIG. 1 shows the internal configuration of the apparatus according to the embodiment. The sound image localization apparatus according to the embodiment is equipped with the DSP 10 which receives an input from one of various sources and processes it, as well as a controller 32, a user interface 33, and a memory 31. The sound image localization apparatus according to the embodiment is also equipped with a D/A converter 22 for converting digital audio output signals of the DSP 10 into analog signals, an electronic volume 41 for adjusting the sound volumes of the audio output signals of the D/A converter 22, and a power amplifier 42 for amplifying audio signals that have passed through the electronic volume 41. The speakers FL and FR, which are provided outside the sound image localization apparatus according to the embodiment, convert output signals of the power amplifier 42 into sounds and output those to a listener (dummy head) 100. The configurations of the individual components will be described below.

The DSP (digital signal processor) 10 shown in FIG. 1 is equipped with the decoder 14 for decoding an input signal and the post-processing DSP 13 for processing output signals of the decoder 14. The decoder 14 receives and decodes one of various kinds of input signals such as a bit stream, a multi-PCM signal, and a multi-bit stream of a digital audio signal. The decoder 14 outputs surround audio input signals, that is, front left and right audio input channel signals Lch and Rch, a front center channel signal Cch, and rear left and right audio input channel signals LSch and RSch.

At least equipped with the rear localization adding section 131 for performing rear localization on the rear audio input channel signals LSch and RSch and adders 135A and 135B, the post-processing DSP 13 processes the surround audio input signals received from the decoder 14 and outputs resulting signals. In the apparatus according to this embodiment, as shown in FIG. 1, only the front speakers FL and FR are installed actually. The DSP 10 performs sound image localization by combining rear audio signals for the rear virtual speakers VL and VR with the audio input channel signals Lch and Rch for the front speakers FL and FR by means of the adders 135A and 135B. The center channel audio input signal Cch is allocated to and combined with the front left and right audio input channel signals Lch and Rch by the adders 135A and 135B. The reason why the signals are mixed down in this manner is that, as mentioned above, outputting multi-channel sounds through real speakers require a large-scale system and is not necessarily practical.

To perform sound image localization for the rear virtual speakers VL and VR corresponding to the rear audio input channel signals LSch and RSch, the rear localization adding section 131 is equipped with filters 131LD, 131LC, 131RC, and 131RD and adders 131L and 131R. Each of the filters 131LD, 131LC, 131RC, and 131RD is implemented by part of the ROM 31 which is provided inside or outside the DSP 10 and a convolution calculating section. FIR filter parameters are stored in the ROM 31 and the convolution calculating section convolves the rear audio input channel signals LSch and RSch with the FIR filter parameters read from the ROM 31. The adder 131L adds together outputs of the filters 131LD and 131RC and the adder 131R adds together outputs of the filters 131RD and 131LC.

To perform sound image localization for the virtual speakers VL and VR by processing the rear audio input channel signals LSch and RSch, the filters 131LD, 131LC, 131RC, and 131RD of the rear localization adding section 131 use filters having characteristics obtained by dividing the gains of the head-related transfer functions which simulate the spatial propagation characteristics from the rear virtual speakers VL and VR to both ears for each angular frequency $\omega$ by the gains of the head-related transfer functions which simulate the spatial propagation characteristics from the front speakers FL and FR to both ears (details will be described later with reference to FIG. 3). As shown in FIG. 1, the outputs of the filters 131LC and 131RC are multiplied by −1 to obtain opposite-phase signals.

The functional block of the adders 131L and 131R shown in FIG. 1 has a calculating section for combining the outputs of the filters 131LD, 131LC, 131RC, and 131RD with each other and supplies resulting signals to the adders 135A and 135B. Instead of multiplying the outputs of the filters 131LC and 131RC by −1, subtraction may be performed by the adders 135A and 135B.

As shown in FIG. 1, the adder 135A has a calculating section for combining (adding) together one of the output signals of the rear localization adding section 131, the front left audio input channel signal Lch, and the center channel audio input signal Cch, and the adder 135B has a calculating section for combining (adding) together the other of the output signals of the rear localization adding section 131, the front right audio input channel signal Rch, and the center audio input signal Cch. The calculating sections supply resulting signals to the D/A converter 22.

The controller 32 shown in FIG. 1 controls operation of the inside of the post-processing DSP 13 according to instructions received from the user interface 33. Various control data to be used for controlling the post-processing DSP 13 are stored in the memory 31. For example, the FIR filter parameters of the rear localization adding section 131 are stored in the memory 31. The user interface 33 has manipulators and a GUI and sends instructions to the controller 32.

The D/A converter 22 shown in FIG. 1 has a D/A converter IC and converts digital audio signals into analog signals.

The electronic volume 41, which is an electronic volume control IC, for example, adjusts the volumes of output signals of the D/A converter 22 and supplies resulting signals to the power amplifier 42. The power amplifier 42 amplifies the analog output signals of the electronic volume 41 and supplies resulting signals to the speakers FL and FR.

Setting of Virtual Sound Sources of Apparatus of Embodiment

The setting of the virtual sound sources of the apparatus according to the embodiment will be described with reference to FIG. 2. FIG. 2 shows a method for this setting and the definitions of the head-related transfer functions used in the apparatus according to the embodiment. As described above, in the apparatus according to the embodiment, sound image localization for the virtual sound sources is performed by processing rear audio input channel signals. As shown in FIG. 2, in this embodiment, the virtual speakers VL and VR are set at the positions that are symmetrical with the front speakers FL and FR with respect to the center line 104. The center line 104 passes through the center of the listener 100 and extends in the right-left direction of the listener 100.

As shown in FIG. 2, setting the virtual speakers VL and VR at the positions that are symmetrical with the front speakers FL and FR with respect to the right-left center line 104 of the listener 100 provides the following merits. Since the propagation distances from the front speakers FL and FR are equal to those of the rear virtual speakers VL and VR, phase differences due to the differences between front/rear propagation times and sound volume differences due to the differences between front/rear propagation distances are approximately the same. Furthermore, since the front/rear angles of incidence of sounds are the same, the differences in the degree of interference occurring in the head can be made small. As a result, it is expected that the phenomenon that complex peaks and dips appear in the frequency characteristics of the filters of the rear localization adding section 131 is suppressed and the apparatus thereby becomes robust, that is, resistant to a positional variation of the listener (dummy head) 100.

Furthermore, in the apparatus according to the embodiment, the front left and right speakers FL and FR are set at the positions that are symmetrical with each other with respect to the line representing the direction 103 of the face of the listener 100 and the rear virtual speakers VL and VR are also set at the positions that are symmetrical with each other with respect to the same line, whereby the left and right head-related transfer functions can be made identical. As a result, it is expected that the phenomenon that complex peaks and dips appear in the frequency characteristics of the filters of the rear localization adding section 131 is further suppressed and the apparatus thereby becomes more robust, that is, more resistant to a positional variation of the listener (dummy head) 100.

Setting of Filters of Rear Localization Adding Section of Apparatus of Embodiment A method for setting the filters of the rear localization adding section 131 will be described below with reference to FIG. 2 which was referred to above and FIGS. 3 and 4.

The head-related transfer functions from the front speakers FL and FR and the rear virtual speakers VL and VR to both heads M1 and M2 are defined as shown in FIG. 2. As shown in FIG. 2, a head-related transfer function of a path from a speaker to an ear that is closer to the speaker is given a symbol having a character "D" (for "direct") and a head-related transfer function of a path from a speaker to an ear that is more distant from the speaker is given a symbol having a character "C" (for "cross"). A head-related transfer function of a path from a rear virtual speaker is given a symbol having characters "Rear." Furthermore, a head-related transfer function of a path from an obliquely left speaker is given a symbol having a character "L" (for "left") and a head-related transfer function of a path from an obliquely right speaker is given a symbol having a character "R" (for "right"). For example, the head-related transfer function of the path from a rear-left path 102LC is represented by RearLC(ω), where as mentioned above ω is the angular frequency (this also applies to the following). Each of the thus-defined head-related transfer functions is a model head-related transfer function. Actual measurement data of the model head-related transfer functions are publicized and hence can be used.

The filters of the rear localization adding section 131 will be described below in a specific manner with reference to FIG. 3. FIG. 3, which is only part (rear localization adding section 131) of FIG. 1, illustrates a setting method of these filters. As shown in FIG. 3, the characteristic of each filter of the rear localization adding section 131 is a ratio between the gains of head-related transfer functions of paths from two positions that are symmetrical with each other with respect to the right-left center line 104 of the listener 100 (refer to the definitions of the head-related transfer functions illustrated by FIG. 2). Symbol "/" which is part of the symbol representing the characteristic of each of the filters 131LD, 131LC, 131RC, and 131RD means gain division for each angular frequency ω (a resulting value is a difference between dB values in the case where the gains are expressed in dB (i.e., by logarithmic representation)). In FIG. 3, the characteristics of the filters 131LD, 131LC, 131RC, and 131RD are expressed as frequency characteristics. However, since input digital audio signals are time-series data, an input signal is convolved with the FIR filter which has the coefficients obtained by converting the frequency characteristic (gain difference).

As shown in FIG. 2, since the virtual sound sources VL and VR are set at the positions that are symmetrical with each other with respect to the line representing the direction 103 of the face of the listener 100 and the speakers FL and FR are also set at the positions that are symmetrical with each other with respect to the same line, the head-related transfer functions can be regarded as right-left symmetrical with each other. Therefore, the characteristics of the filters 131LD and 131RD are identical and the characteristics of the filters 131LC and 131RC are identical.

Figure 4A:
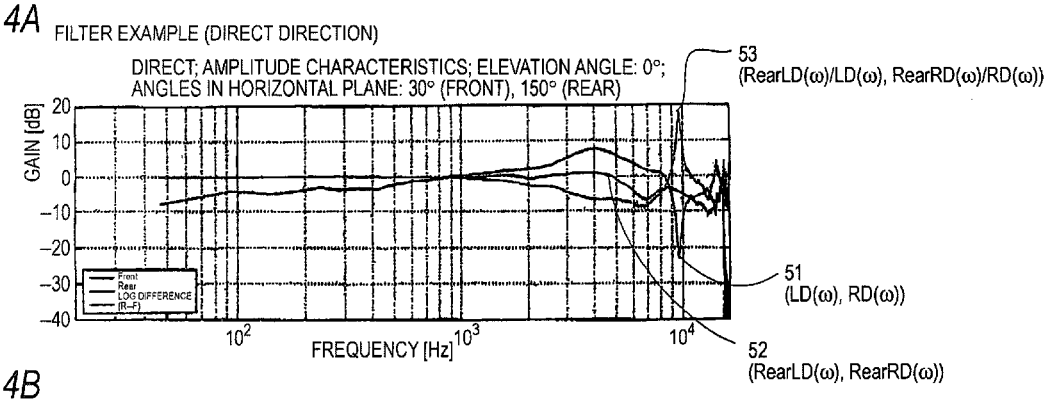
FIGS. 4A and 4B show examples of the filters of the rear localization adding section of the sound image localization apparatus according to the embodiment.
Figure 4B:
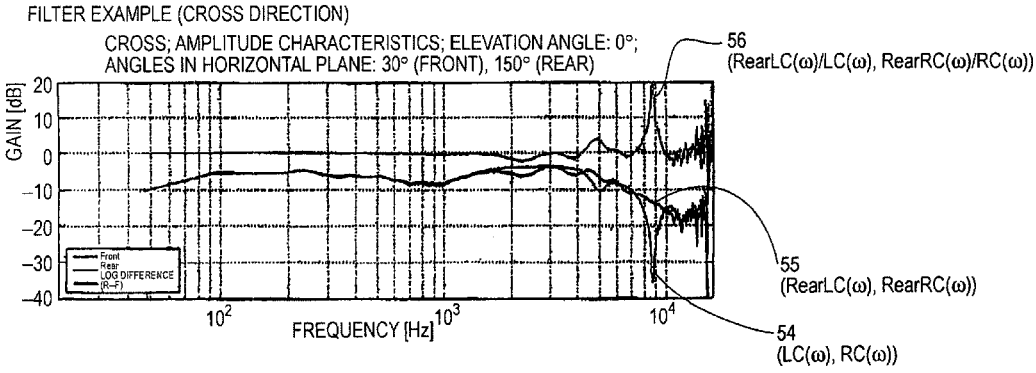

Specific examples of the filters of the rear localization adding section 131 will be described below with reference to FIGS. 4A and 4B. FIGS. 4A and 4B show exemplary characteristics of the filters 131LD, 131LC, 131RC, and 131RD of the case that the virtual sound sources VL and VR are set at the positions that are symmetrical with each other with respect to the line representing the direction 103 of the face of the listener 100 and the speakers FL and FR are also set at the positions that are symmetrical with each other with respect to the same line (see FIG. 3). Therefore, the frequency characteristics of the filters 131LD and 131RD are identical and the frequency characteristics of the filters 131LC and 131RC are identical. A curve 53 representing the characteristic of the filters 131LD and 131RD is shown in FIG. 4A. A curve 56 representing the characteristic of the filters 131LC and 131RC is shown in FIG. 4B.

In the examples of FIGS. 4A and 4B, the setting angle of the front speakers FL and FR is 30° with respect to the direction 103 of the face of the listener 100 and that of the rear virtual speakers VL and VR is 150° with respect to the direction 103. With this setting, the front speakers FL and FR are symmetrical with the virtual sound sources VL and VR with respect to the center line 104 shown in FIG. 2.

As shown in FIG. 4A, the frequency response of the filters 131LD and 131RD which is represented by the curve 53 is a frequency response obtained by dividing the gain of a head-related transfer function RearLD(ω), RearRD(ω) (RearLD(ω)=RearRD(ω) represented by a curve 52 by the gain of a head-related transfer function LD(ω), RD(ω)(LDω)=RD(ω) represented by a curve 51 (a resulting value is a difference between dB values in the case where the gains are expressed in dB (i.e., by logarithmic representation)). Likewise, the frequency response of the cross-direction filters 131LC and 131RC which is represented by the curve 56 as shown in FIG. 4B is a frequency response obtained by dividing the gain of a head-related transfer function represented by a curve 54 by the gain of a head-related transfer function represented by a curve 55. These head-related transfer functions are ones corresponding to the above-mentioned speaker setting angles.

Implementation of the filters whose characteristics are shown in FIGS. 4A and 4B will be described. The characteristics of the filters of the rear localization adding section 131 are determined in advance as factory setting values by calculating gain division values as shown in FIGS. 4A and 4B, and stored in the memory 31 shown in FIG. 1 as FIR filter parameters. Plural sets of FIR filter parameters may be set for various patterns of speaker setting angles with respect to the direction 103 of the face of the listener 100. For example, this makes it possible to select a set of parameters in accordance with speaker setting angles that are set by a user (these pieces of information are input through the user interface 33). The controller 32 reads out filter coefficients corresponding to these angles as control parameters for the rear localization adding section 131, and supplies those to the rear localization adding section 131. As described above with reference to FIG. 1, on the basis of these FIR filter parameters, each filter of the rear localization adding section 131 convolves a rear audio input channel signal LSch or RLch with its FIR filter characteristic.

An experiment that was conducted by the inventors confirmed that the apparatus according to the embodiment causes, more reliably, a listener to feel as if sounds were being output from behind though they are actually output from front speakers than signal processing (inverse-of-matrix calculations) of crosstalk cancellation does. It is supposed that the above-described division calculations produce an effect similar to the crosstalk cancellation which cancels transfer characteristics from the front speakers FL and FR to both ears M1 and M2.

The aspect of the invention recited in claim 1 can be expressed differently as follows:

(A) The invention provides a sound image localization apparatus comprising:

a filter calculating section for performing convolution calculations and addition calculations according to the following formula:

$$\text{Output}L = LD(z) \times LSch - RC(z) \times RSch$$

$$\text{Output}R = -LC(z) \times LSch + RD(z) \times RSch$$

("x" means convolution and "+" means addition)

where LSch and RSch are audio signal sequences of rear left and right audio input channels and transfer functions LD(z), LC(z), RC(z), and RD(z) are expressed by matrices; and an adding section for adding OutputL and OutputR as calculation results of the filter calculating section to respective audio signals Lch and Rch that are audio signals themselves of front left and right audio input channels or are obtained by performing signal processing on the audio signals of front left and right audio input channels, wherein:

the filter calculating section uses, as LD(z), LC(z), RC(z), and RD(z), impulse responses corresponding to frequency responses of a gain ratio of RLD(ω) and LD(ω), a gain ratio of RLC(ω) and LC(ω), a gain ratio of RRC(ω) and RC(ω), and a gain ratio of RRD(ω) and RD(ω), respectively, where:

ω is an angular frequency; LD(ω) and LC(ω) are head-related transfer functions which simulate spatial propagation characteristics from an actual-installation-assumed front-left speaker to left and right ears, respectively; RC(ω) and RD(ω) are head-related transfer functions which simulate spatial propagation characteristics from an actual-installation-assumed front-right speaker to the left and right ears, respectively; VLD(ω) and VLC(ω) are head-related transfer functions which simulate spatial propagation characteristics to the left and right ears from a rear-left virtual speaker that is front-rear symmetrical with the front-left speaker with respect to a right-left center line of a listener, respectively; and VRC(ω) and VRD(ω) are head-related transfer functions which simulate spatial propagation characteristics to the left and right ears from a rear-right virtual speaker that is front-rear symmetrical with the front-right speaker with respect to the right-left center line, respectively. Here, through this specification, "R" means "Rear", for example, RLD(ω) means Rear LD(ω), and RRD(ω) means Rear RD(ω).

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-379625 filed on Dec. 28, 2005, the contents of which are incorporated herein for reference.

What is claimed is:

1. A sound image localization apparatus comprising:

an L direct output section that produces an output signal by inputting an audio signal of a rear left audio input channel to a filter having a characteristic obtained by dividing RLD by LD;

an L cross output section that produces an output signal by inputting the audio signal of the rear left audio input channel to a filter having a characteristic obtained by dividing RLC by LC;

an R cross output section that produces an output signal by inputting an audio signal of a rear right audio input channel to a filter having a characteristic obtained by dividing RRC by RC;

an R direct output section that produces an output signal by inputting the audio signal of the rear right audio input channel to a filter having a characteristic obtained by dividing RRD by RD;

a first adding section that adds a difference signal between the output signal of the L direct output section and the output signal of the R cross output section to an audio signal of a front left audio input channel; and a second adding section that adds a difference signal between the output signal of the R direct output section and the output signal of the L cross output section to an audio signal of a front right audio input channel, wherein:

LD is a head-related transfer function which simulates spatial propagation from a real speaker FL disposed at a front-left position to a left ear;

LC is a head-related transfer function which simulates spatial propagation from the real speaker FL to a right ear;

RC is a head-related transfer function which simulates spatial propagation from a real speaker FR disposed at a front-right position to the left ear;

RD is a head-related transfer function which simulates spatial propagation from the real speaker FR to the right ear;

RLD is a head-related transfer function which simulates spatial propagation to the left ear from a virtual speaker VL which is disposed symmetrically with the real speaker FL with respect to a center line L that passes through the center of a head of a listener and extends in a right-left direction of the listener;

RLC is a head-related transfer function which simulates spatial propagation from the virtual speaker VL to the right ear;

RRC is a head-related transfer function which simulates spatial propagation to the left ear from a virtual speaker VR which is disposed symmetrically with the real speaker FR with respect to the center line L; and RRD is a head-related transfer function which simulates spatial propagation from the virtual speaker VR to the right ear.

2. The sound image localization apparatus according to claim 1, wherein the real speakers are set so as to be symmetrical with each other with respect to the right-left direction of the listener and the virtual speakers are set so as to be symmetrical with each other with respect to the right-left direction of the listener; and wherein the head-related transfer functions LD and RD are identical, LC and RC are identical, RLD and RRD are identical, and RLC and RRC are identical.

* * * * *